US008119916B2

(12) United States Patent
Caccia

(10) Patent No.: US 8,119,916 B2
(45) Date of Patent: Feb. 21, 2012

(54) FLEXIBLE CABLE HAVING A DUAL LAYER JACKET

(75) Inventor: Howard G. Caccia, Antioch, IL (US)

(73) Assignee: Coleman Cable, Inc., Waukegan, IL (US)

( * ) Notice: Subject to any disclaimer, the term of this patent is extended or adjusted under 35 U.S.C. 154(b) by 0 days.

(21) Appl. No.: 12/934,103

(22) PCT Filed: Dec. 9, 2009

(86) PCT No.: PCT/US2009/067330

§ 371 (c)(1),
(2), (4) Date: Sep. 23, 2010

(87) PCT Pub. No.: WO2010/104538

PCT Pub. Date: Sep. 16, 2010

(65) Prior Publication Data

US 2011/0303487 A1 Dec. 15, 2011

Related U.S. Application Data

(60) Provisional application No. 61/156,675, filed on Mar. 2, 2009.

(51) Int. Cl.
*H01B 7/00* (2006.01)

(52) U.S. Cl. ..... 174/110 R; 174/113 R; 174/120 R

(58) Field of Classification Search ..... 174/110 R, 174/113 R, 120 R, 120 AR, 120 SR
See application file for complete search history.

(56) References Cited

U.S. PATENT DOCUMENTS

| | | | |
|---|---|---|---|
| 2,718,544 | A | 9/1955 | Shepp |
| 2,744,153 | A | 5/1956 | Flood |
| 2,856,453 | A | 10/1958 | Shepp |
| 3,013,109 | A | 12/1961 | Gorman et al. |
| 3,209,064 | A | 9/1965 | Cutler |
| 3,710,007 | A | 1/1973 | Hoeg et al. |
| 3,805,218 | A | 4/1974 | Voida |
| 3,993,860 | A | 11/1976 | Snow et al. |
| 4,125,741 | A | 11/1978 | Wahl et al. |

(Continued)

FOREIGN PATENT DOCUMENTS

EP 0751535 A2 1/1997

OTHER PUBLICATIONS

The International Bureau of WIPO, International Preliminary Report on Patentability and Written Opinion of the International Searching Authority for corresponding PCT application No. PCT/US2009/067330, Sep. 6, 2011.

(Continued)

*Primary Examiner* — William Mayo, III
(74) *Attorney, Agent, or Firm* — Patzik, Frank & Samotny Ltd.

(57) ABSTRACT

A flexible multi-conductor cable and a method of manufacturing a flexible multi-conductor cable, wherein the cable is adapted for use, particularly, in a mechanical cable track type lifting device. The cable includes two or more insulated conductors surrounded by a dual layer jacket. The dual layer jacket includes an inner layer having a TPE material with a higher tensile modulus, and an outer layer having a TPE material with a lower tensile modulus. The material of the cable is selected so that the cable is capable of surviving the external physical requirements of a mechanical cable track, as well as to prevent the transfer of the wiping effect onto the conductors.

16 Claims, 10 Drawing Sheets

U.S. PATENT DOCUMENTS 4,196,307 A 4/1980 Moore et al.
4,443,657 A 4/1984 Hill et al.
4,486,623 A 12/1984 Ploppa
4,538,022 A 8/1985 Barnicol-Ottler et al.
4,645,298 A 2/1987 Gartside, III
4,654,476 A 3/1987 Barnicol-Ottler et al.
4,658,089 A 4/1987 Guzy et al.
4,675,475 A 6/1987 Bortner et al.
4,687,294 A 8/1987 Angeles
4,732,628 A 3/1988 Dienes
4,789,589 A 12/1988 Baxter
5,043,037 A 8/1991 Buckland
5,043,530 A 8/1991 Davies
5,113,040 A 5/1992 Hose et al.
5,114,746 A 5/1992 O'Leary et al.
5,173,960 A 12/1992 Dickinson
5,192,834 A 3/1993 Yamanishi et al.
5,210,377 A 5/1993 Kennedy et al.
5,220,130 A 6/1993 Walters
5,238,328 A 8/1993 Adams et al.
5,280,137 A * 1/1994 Ward ..... 174/120 SR
5,313,020 A 5/1994 Sackett
5,669,517 A 9/1997 Donaldson et al.
5,750,931 A 5/1998 McGregor et al.
6,140,587 A 10/2000 Sackett
6,160,940 A 12/2000 Summers et al.
6,180,721 B1 * 1/2001 Rogestedt et al. ..... 525/191
6,184,473 B1 2/2001 Reece et al.
6,362,432 B1 3/2002 LaPidus et al.
6,469,251 B1 10/2002 Dupuis
6,519,396 B2 2/2003 Schneider et al.
6,528,730 B2 3/2003 Persson
6,573,456 B2 6/2003 Spruell et al.
6,861,143 B2 3/2005 Castellani et al.
6,897,382 B2 5/2005 Hager et al.
7,105,749 B2 9/2006 Belli et al.
7,123,801 B2 10/2006 Fitz
7,132,604 B2 11/2006 Scheidecker et al.
7,180,000 B2 2/2007 Hager et al.
7,759,580 B2 * 7/2010 Park et al. ..... 174/121 A
2001/0040042 A1 11/2001 Stipes
2002/0096356 A1 * 7/2002 Kim et al. ..... 174/137 A
2004/0050580 A1 3/2004 Hager et al.
2004/0055771 A1 3/2004 Wiekhorst et al.
2005/0077066 A1 4/2005 Stipes
2005/0087360 A1 4/2005 Speer
2006/0021772 A1 2/2006 Dellagala et al.
2006/0237219 A1 10/2006 Glew

OTHER PUBLICATIONS

Korean Intellectual Property Office, International Search Report and Written Opinion of the International Searching Authority for corresponding PCT application No. PCT/US2009/067330, Jul. 14, 2010.
Electro-Matic Products, Inc., High Flex Cables Multi-Conductor Control—600V, 2006.
Alpha Wire Company, web page at http://www.alphawire.com/pages/89.cfm, printed Jun. 2, 2008.
Northwire, Inc., "Know Your High-Flex-Life Cable", Aug. 2007.
Bay Associates, web page at http://www.baycable.com/html/high_flex.html, printed Jun. 2, 2008.
Honeywell, Technical Data on Genesis Semi-Extruded Jacket, (undated).
Fisk Alloy Conductors, Inc., "Conductor Facts," (undated).
Wikipedia, definition "Flexible Cables" printed, Jun. 2, 2008.
Leoni, "Concentric Stranded Conductors", product configurations (undated).

* cited by examiner

FLEXIBLE CABLE HAVING A DUAL LAYER JACKET

CROSS-REFERENCE TO RELATED APPLICATION

This application claims the benefit of U.S. Provisional Patent Application No. 61/156,675, filed Mar. 2, 2009.

FIELD OF THE INVENTION

The present invention relates to flexible cables and, in particular, multi-conductor cables for use in a mechanical cable track.

BACKGROUND OF THE INVENTION

Cables are made in various ways, using materials and processes suitable for the internal and external mechanical, environmental and Listing Agency standards and requirements. Combinations of conductors are also assembled, using various methods to produce constructions with unique properties and performance characteristics, including those necessary to survive flexing applications. This area of practice and these methods are all well documented.

The prior art includes mechanical cable tracks that house various electrical as well as hydraulic lines used to carry power from one point to another on construction equipment. Specifically, lift devices of the kind used to lift a worker to some height and allow specific tasks to be performed. These tasks, along with the control of the unit itself, require the use of various single and multi-conductor cables. Multiple electrical conductors under one protective jacket is an efficient means of bundling the number of wires needed in a compact design, as well as providing efficient means of connecting the cables. The flexible track space is minimized, for cost and space reasons, so efficient use of that space is important. Since the track provides the power and control of the unit, and the unit is run by one person from the basket, durability and reliability of the cables are critical.

FIG. 1 is an example of a prior art lift device. The typical components include a base unit, an articulated boom having the mechanical cable track, and a worker platform.

Applicant has conducted extensive research and development as to the superior construction of a cable in such an environment as described herein.

In one prior art embodiment, the track application involves link type tracks which the industry refers to as "C" tracks. FIG. 2 shows the links of a simulated mechanical cable track connected at the pivot points, with bars extending across to connect the links. The links are designed to facilitate relatively small radius bends (see FIG. 3) and are used to allow for continuous operation of the device during the lifting/extension and maneuvering sequences. The track houses various cables to provide power and control connections between a base unit and some device (such as a basket or cage for a worker) at the end of the extended "arm" or boom. The links of the track include pivot joints on each end and these links are attached side to side by flat plates, bars or rollers creating a "track or link". These tracks travel in two directions and one plane. They have an extension and contraction mode. During the extension mode, the cable contacts the inner track link connection device/method (i.e., the flat plate, bar or roller) of the chain links and at the pivot of the link or chain there is considerable contact, rubbing, or wiping of the cable against the device. This occurs at each pivot or contact point of the track. Tracks are used in varying lengths depending on the reach or extension needed. This "smooth surface" abrasion is particularly abusive to materials like rubber (CPE) and/or Neoprene, and these materials, while they have substantial tensile modulus properties, break down and wear out fairly quickly (e.g., less than 15,000 track cycles), thereby exposing the insulated conductors. Conversely, typical thermoplastic elastomers and PVC's typically exhibit lower tensile modulus properties combined with a lower surface coefficient of friction, allowing them to perform well in smooth surface abrasion contact conditions, but they are generally not robust enough to prevent the transfer of the track wiping effect.

During the contraction mode the cable is allowed to relax. However, no reversal of the forces implied on the cable occurs. Therefore, the stresses on the cable are only and always in one direction, e.g., the extension mode of the unit. Conventional wisdom would attempt to describe the force applied to the cable as torsional in nature. This false conclusion is suggested after observation of the cable. In particular, the cables take on a twisted or ropey appearance which occurs when cables experience excessive torsional load or forces. However, the applicant has discovered that the force applied is not torsional. The force can best be described as a wiping or "milking" force applied to the cables outer contact surface, such as seen in FIG. 4. If the force were torsional in nature, the conductors would exhibit a regular twisting shape with the conductor lay length being reduced uniformly along the length exposed to the force. Instead, the applicant has discovered that what occurs is a distinct and consistent change in lay length that is not evenly distributed along the length. The impact is observed as only occurring near the pivot end of the track where the cable is contacted by the flat plate, bar or roller of the link connection. It is believed that the elongation properties of the jacket allow for the displacement (stretching) of the jacket and subsequent transfer of force to the conductor layer. Since the contact occurs over the entire width of the track blade (e.g., approximately 3 inches), the pressure wipes against the conductors influencing the lay and creating the rope or twisting effect, such as seen in FIGS. 5 and 6. Materials that are less susceptible to stretching or elongation (i.e., have high tensile modulus properties) cannot be effectively used as an outer jacket material as they fracture or wear out under the regular contact and wiping of the track or are not flexible enough to be installed and used with the relatively small bend radius of typical C tracks.

The prior art includes multi-conductor cables produced with a conductor lay length to allow the cable to withstand repeated flexing. In particular, the conductor lay or spiral allows the conductor to avoid being stressed in the same place and in the same plane repetitively. However, if the conductor is subjected to a tightening of the lay, such that the conductor exhibits what the industry refers to as a "Z" kink, the conductors will be effectively locked in a position. As a result, the conductor will be subjected to damage. The damage is a result of the copper strands being subjected to flexing and stressing that causes the conductor to be work-hardened and to lose elongation. The loss of elongation and work hardening leads to conductor breakage and electrical failure.

Applicant conducted research into the impact of wiping upon a cable, with multiple conductors and made with a specific lay length. In particular, after track testing, the lay length can be re-measured and the effects recorded. What was found by Applicant was a lengthening of lay followed abruptly by a reduction in lay length. The effects are also visible on the outside of the cable. That is, the cable assumes a twisting or rope like appearance. This appearance is actually the result of a lengthening of lay length in one spot followed by a tightening or accumulating of lay length in an adjacent spot. These intervals of tightening and accumulating will repeat along the length of the cable that has experienced the track effect and will not occur where the same cable length has not experienced this contact. Where contra-helical conductor layers are utilized, the force (track wiping) can be transferred from the outer conductor layer to the layer just underneath it, since the layers are wound in opposite directions, the outer layer can force the inner layer conductors to buckle (this has been observed in actual track testing). In the most extreme circumstances of the "tightening" (or more accurately the accumulation or reduction) of the lay, the effect is so extreme as to create a bunching up of the conductors. Where no lay length is evident, the conductors cannot wipe down any further and the conductors can be the subject of damage as a result of this bend. The industry refers to this as a "Z" kink. FIG. 7 shows sample conductors exhibiting such features. The jacket has been removed to better demonstrate the effect on the conductors. FIG. 7A shows the lengthening of the lay followed by the reduction in conductor lay. The G1 sample included only a single layer pressure extruded jacket. The G-3 sample in FIG. 7B is the same conductor combination however wherein the inner and outer layer concept was utilized, as taught by the present invention, and as further described below.

SUMMARY OF THE INVENTION

The present invention provides a flexible multi-conductor cable and a method of manufacturing a flexible multi-conductor cable, wherein the cable is adapted for use, particularly, in a mechanical cable track. The material of the cable is preferably selected so that the cable is capable of surviving the external physical requirements of a mechanical cable track, as well as to: prevent the transfer of the wiping effect onto the conductors; allow low friction intimate contact with insulated conductors and conductor layers; prevent compression of the inner conductor layers creating the opportunity for Z kinking by a single conductor or multiple conductors; and be suitable for smooth surface abrasion applications. In one embodiment, the cable includes 18 AWG or larger conductors for power and control applications. The cable is designed to withstand prolonged exposure to −40° C. temperatures with no movement of the cable followed by repeated extension and contraction cycles. Further, the cable is designed to withstand UV exposure, weather, dust and dirt, concrete, and the casual oil or grease contact.

DETAILED DESCRIPTION OF THE PRESENT INVENTION

Figure 1:
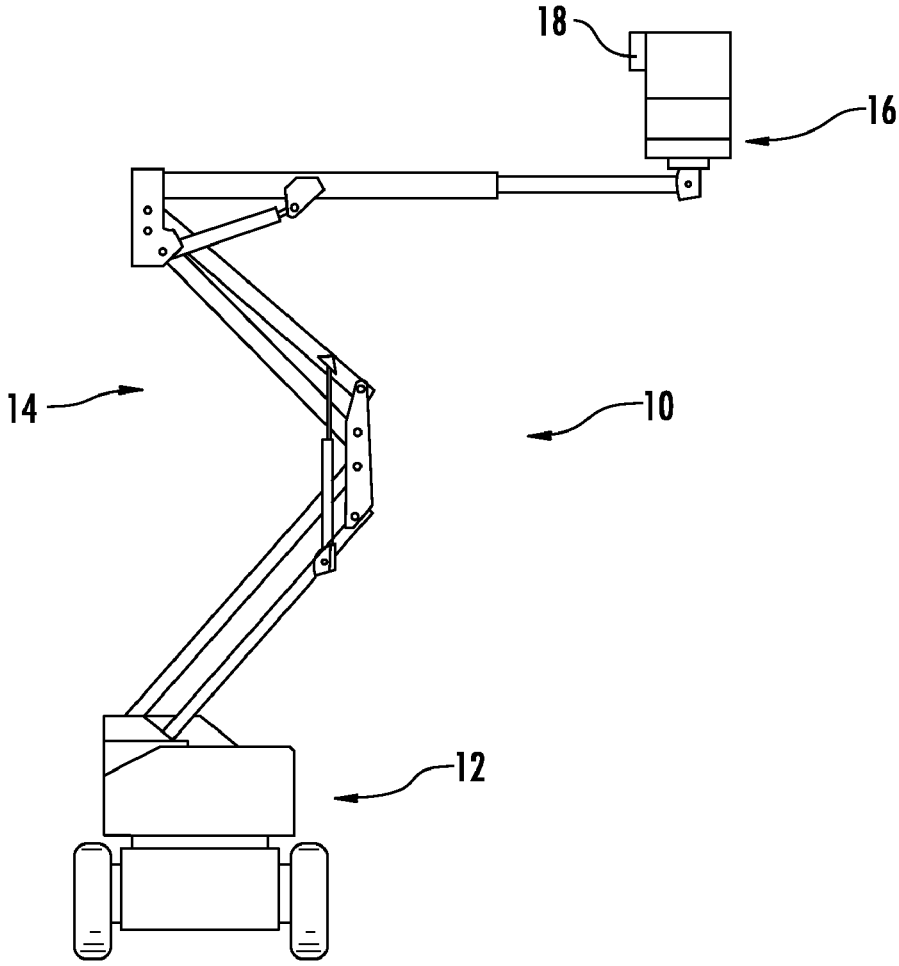
FIG. 1 (PRIOR ART)
FIG. 1 is a front elevated view of a prior art lifting device.
Figure 2:
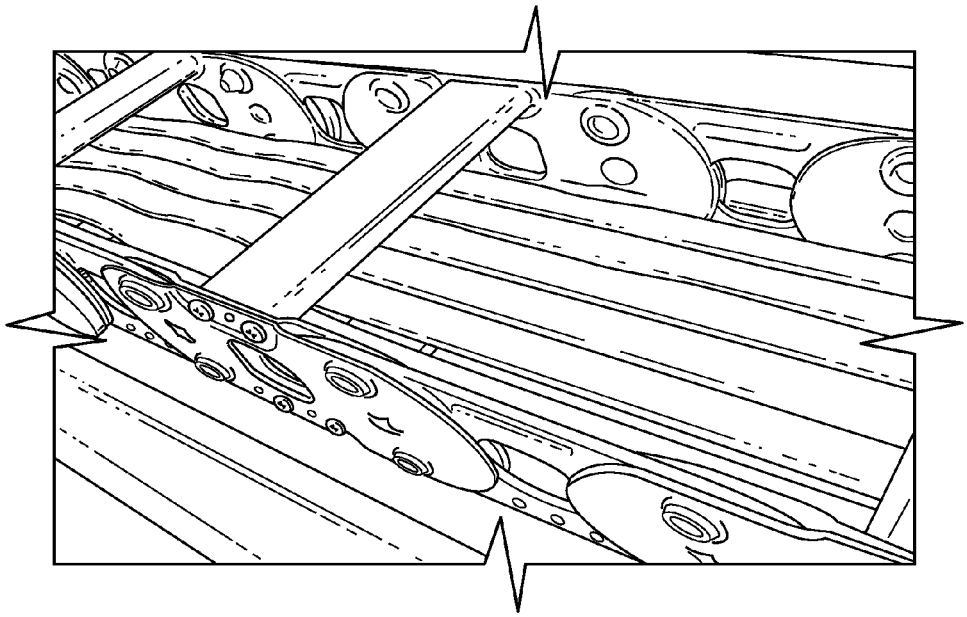
FIG. 2 (PRIOR ART)
FIG. 2 is a perspective elevated view of a portion of a mechanical cable track of a lifting device, together with a plurality of prior art cables each having a plurality of conductors.
Figure 3:
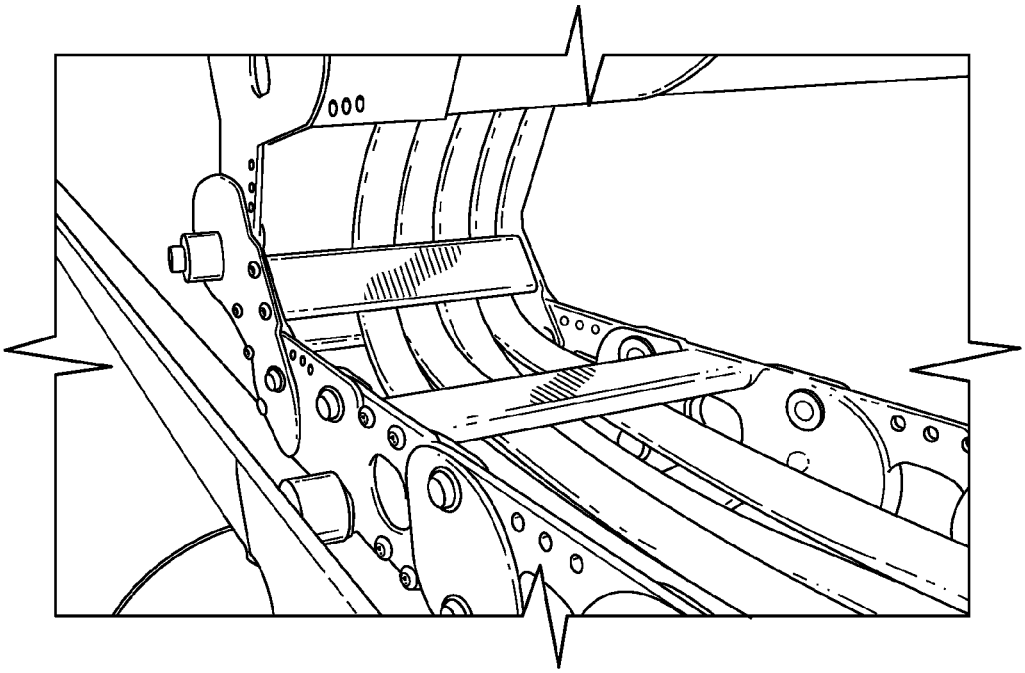
FIG. 3 (PRIOR ART)
FIG. 3 is a perspective view of a portion of the mechanical cable track and prior art cables of FIG. 2.
Figure 4:
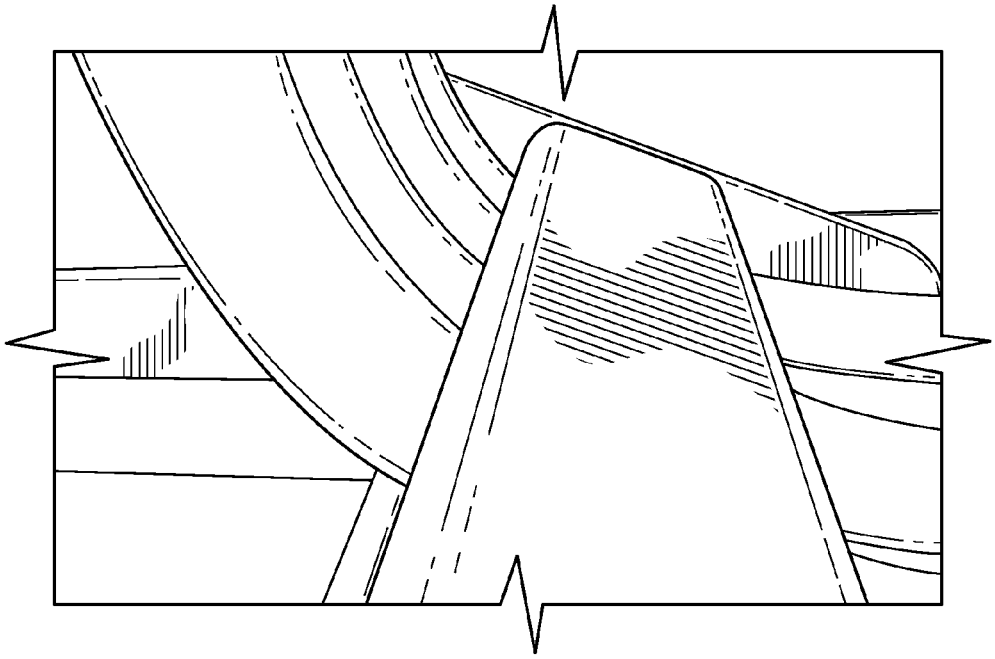
FIG. 4 (PRIOR ART)
FIG. 4 is a perspective side view of a portion of the mechanical cable track and prior art cables of FIG. 2.
Figure 5:
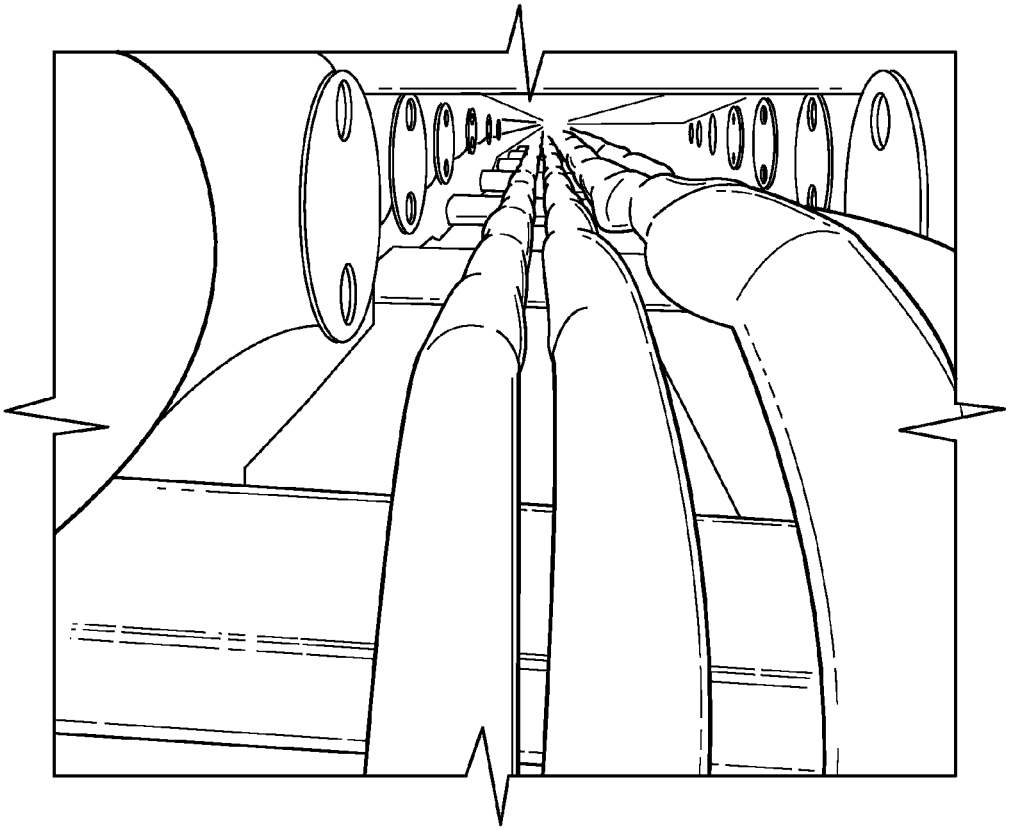
FIG. 5 (PRIOR ART)
FIG. 5 is a perspective end view of a portion of the mechanical cable track and prior art cables of FIG. 2.
Figure 6:
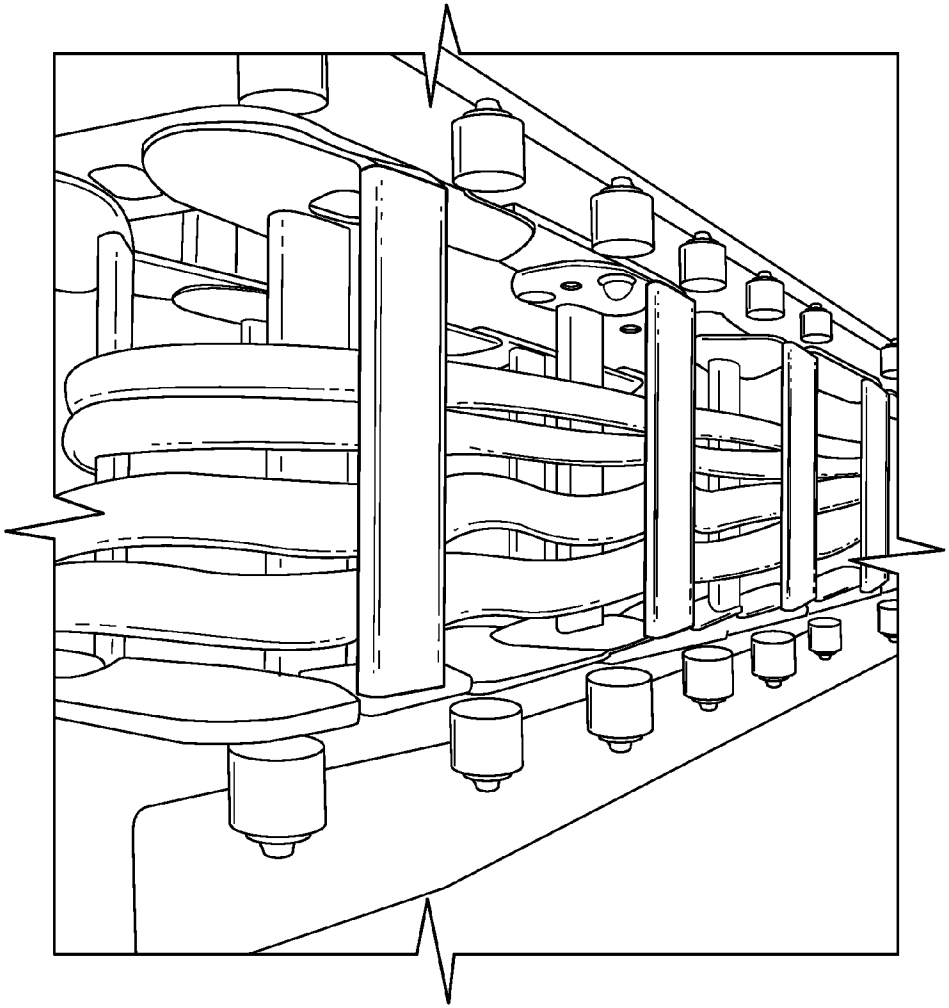
FIG. 6 (PRIOR ART)
FIG. 6 is a partial perspective elevated end view of a portion of the mechanical cable track and prior art cables of FIG. 2.
Figure 7A:
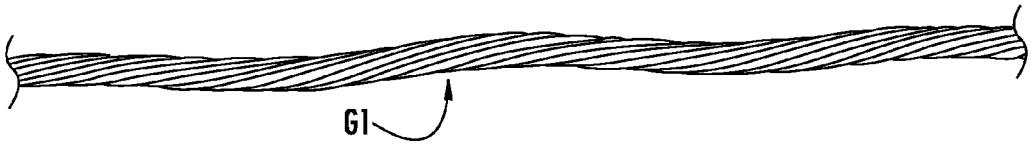
FIG. 7A (PRIOR ART)
FIG. 7A is a plan view of prior art cable, with the jacket removed to expose the plurality of conductors G1.
Figure 7B:
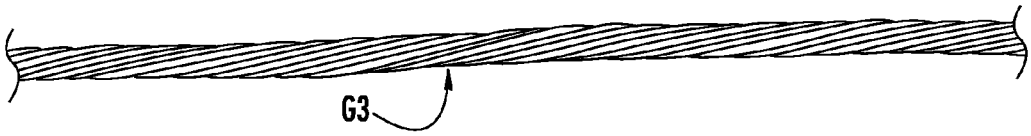
FIG. 7B is a plan view of a cable in accordance with the present invention, with the jacket removed to expose the plurality of conductors G3.

As noted above, FIG. 1 shows one example of a prior art lifting device 10. The typical embodiment includes a base unit 12, an articulated boom 14 which includes a mechanical cable track, and a worker platform 16. The worker platform 16 will accommodate one or more workers. As there is no operator located in the base unit 12, a control system 18 is located at the worker platform 16 so that the workers may operate the lift device from the worker platform 16. Thus, a cable system providing control and power extends between the base unit 12 and the worker platform 16. FIGS. 2-6 illustrate a portion of such a prior art cable system extending along a cable track. The cable system extends along the length of the articulated boom 14.

The articulated boom 14 is shown in FIG. 1 to be in an extended position. It will be appreciated that the articulated boom 14 may be collapsed or folded upon itself with the worker platform 16 located just above the base unit 12.

Figure 8:
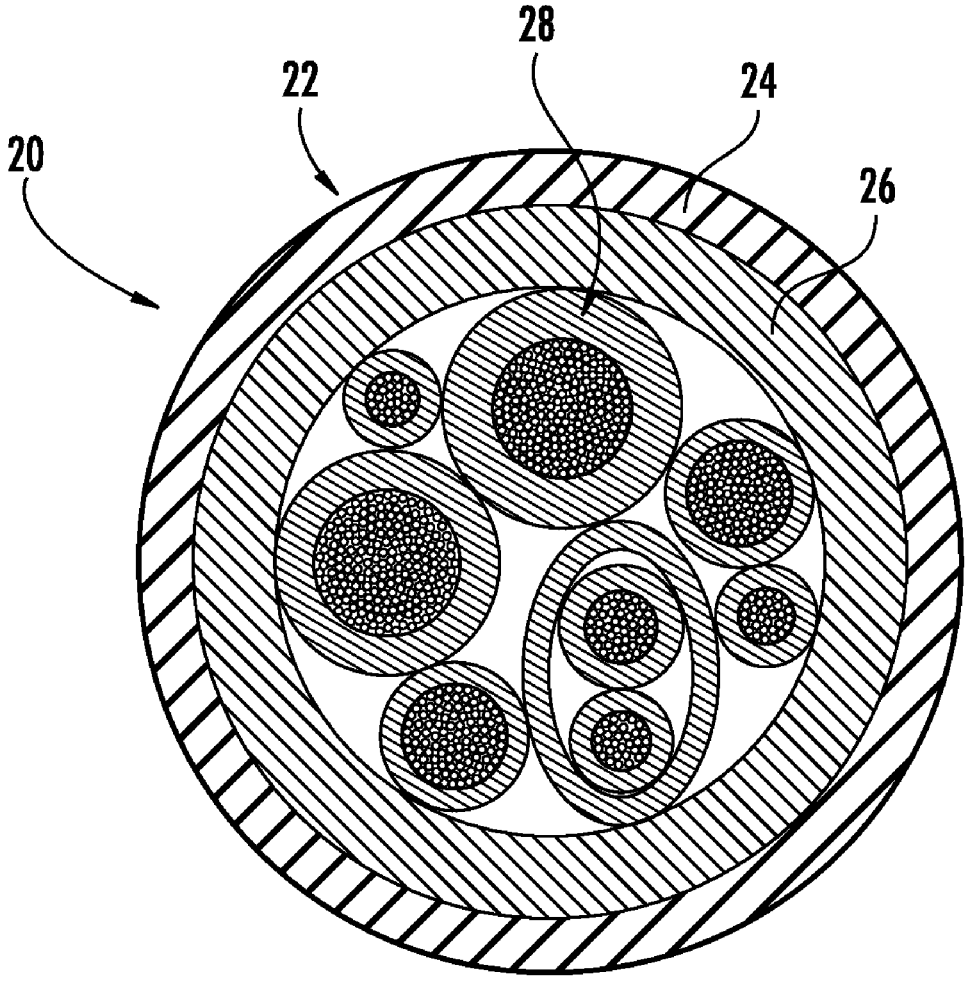
FIG. 8 is a cross-section of a cable in accordance with one embodiment of the present invention.

FIG. 8 shows one embodiment of a cable 20 in accordance with the present invention for use in the above noted cable system. The cable 20 includes a dual layer jacket 22. The jacket 22 includes an outer layer 24 and an inner layer 26. The cable 20 further includes a plurality of insulated conductors 28. The insulated conductors 28 may provide for power and control applications.

The dual layer jacket 22 includes a material which resists track abrading on the outer layer 24 of the jacket 22 and a material which resists stretching on the inner layer 26 of the jacket 22. Both materials include a formula of thermoplastic elastomers (TPE). However, the properties of the inner layer 26 and the outer layer 24 differ in order to achieve the objective of the present invention. In particular, the material of the inner layer 26 is provided with a high tensile modulus to resist stretching forces externally applied to the cable. In comparison, the material of the outer layer 24 is provided with a low tensile modulus to avoid breakdown and cracking as the cable is wiped or rubbed against external surfaces. In one embodiment, the tensile modulus of the inner layer 26 is 1572 psi and the tensile modulus of the outer layer 24 is 1232 psi. It will be appreciated that in this just noted embodiment, the tensile modulus of the inner layer 26 is 27.6% greater in comparison to the outer layer 24.

The tensile and elongation properties of the inner layer 26 and outer layer 24 are chosen to withstand the environment of the noted application.

By co-extruding the two materials together, the finished cable 20 is able to withstand all subject forces and exposures. Since the materials are similar in base chemistry, no bonding agents or bonding layers are necessary. Since the materials are substantial in their specific properties, there is no need for additional layers of materials or other means required to obtain suitable cable performance. For instance, it is not necessary to include inner jacket layers, binders, braids or other mechanical components. Some binders or wraps may be used for holding one group together during the manufacturing process, or to reduce friction between members, but these additions are not required to improve the cables ability to withstand the wiping of the track. The combination of materials is so resistant that good cable geometry and design are not required. That is, the absence of spaces between components, contra-helical conductor layers and perfect conductor count are not required. For example, in the embodiment shown in FIG. 8, the "tubed" jacketed cable 20 has no concentric layers, and the gaps or open interstices are clearly visible, with no pressure extrusion to "trap" the conductors 28. However, certainly a pressure extruded application would also benefit from the present invention.

The following chart shows the properties of the inner layer 26 and outer layer 24 of the jacket 22, for one embodiment of the present invention.

| Property | Outer Layer (24) Lower Tensile Modulus | Inner Layer (26) Higher Tensile Modulus | Difference in properties |
|---|---|---|---|
| Tensile Strength | 2179 Pa | 2393 Pa | 9.8% increase |
| Elongation | 323% | 340% | 5.3% increase |
| Tensile Modulus | 1232 psi | 1572 psi | 27.6% increase |
| Hardness | @15 sec 71 A Instant 82 A | 82 A | N/A |
| Temperature Rating | 105 deg C. | 105 deg C. | Same |
| Polymer | TPE | TPE | Same |
| Brittle Temperature | −49 C. | −49 C. | Same |

Figure 9:
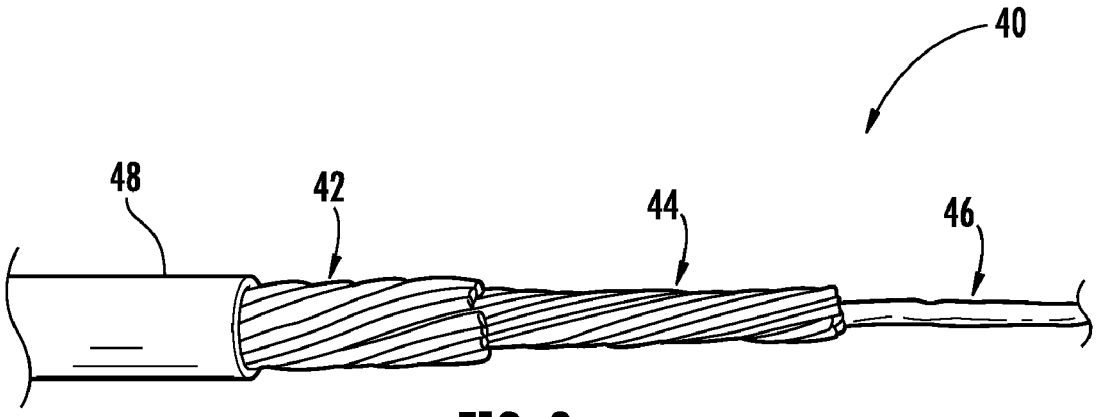
FIG. 9 is a side view of a cable in accordance with another embodiment of the present invention.

FIG. 9 shows another embodiment of the cable of the present invention. The cable 40 is shown to include an outer layer 42 of twelve conductors, an inner layer 44 of six conductors and a central pair 46. The dual layer jacket 48 is also shown.

Figure 10:
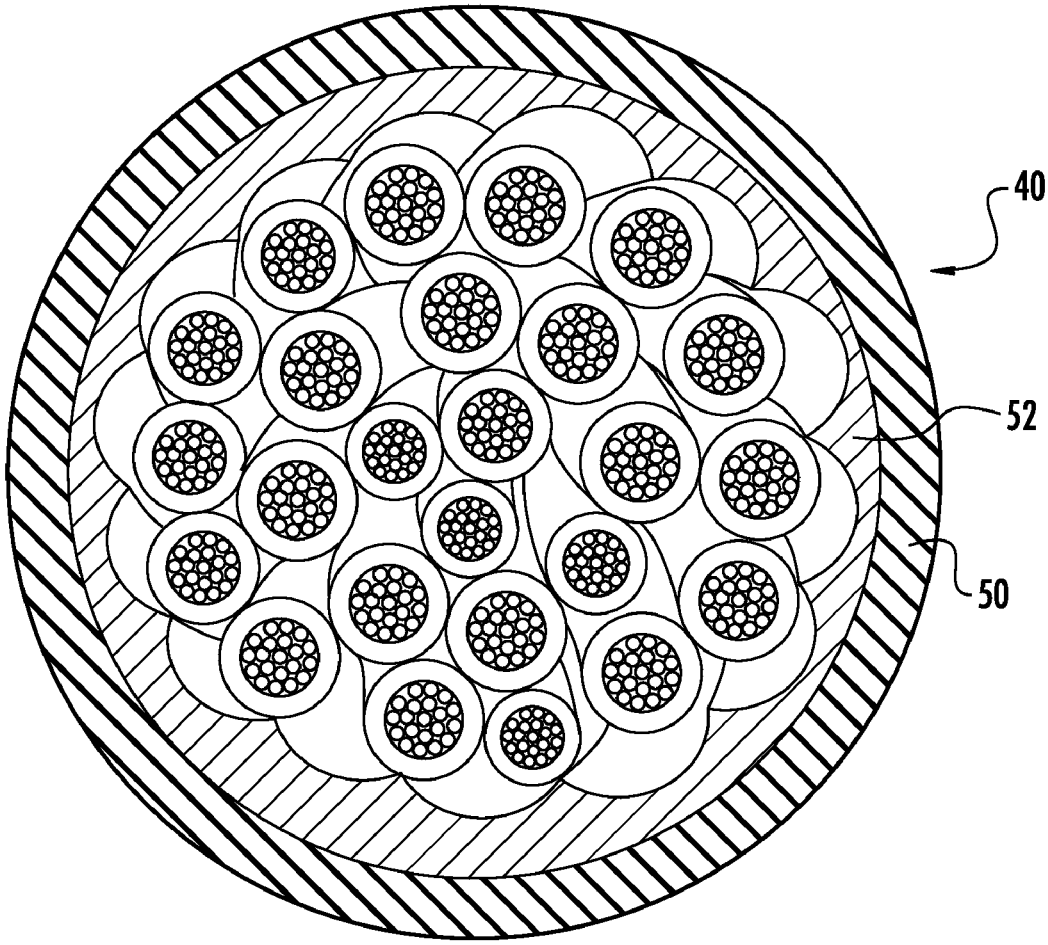
FIG. 10 is a cross-section of the cable of FIG. 9.

FIG. 10 is a cross sectional view of the cable 40 of FIG. 9. The outer layer 50 and inner layer 52 are shown. It will also be appreciated that the embodiment shown is a pressure extruded application about the insulated conductors. However, the present invention is equally applicable to a "tubed" jacket application about the insulated conductors. It should also be noted that there are no inner layer of extruded material within the interstices formed by the conductors.

It will be understood that modifications and variations may be effected without departing from the scope of the novel concepts of the present invention, but it is understood that this application is limited only by the scope of the appended claims.

We claim:

1. A multi-conductor cable adapted for use, particularly, in a mechanical cable track, wherein the cable is subjected to contraction in the extension mode of the track, and a wiping or milking action is applied to the outer contact surface of the cable, the cable comprising:

two or more insulated conductors, the conductors are 20 AWG or larger in size; and a dual layer jacket, the dual layer jacket having an inner layer jacket having a thermoplastic elastomer having a tensile modulus of at least 1550 psi to resist stretching forces externally applied to the cable, and an outer layer jacket having a thermoplastic elastomer having a tensile modulus no greater than 1300 psi, wherein the inner layer and outer layer are co-extruded, which co-extrusion naturally forms distinct, but inseparable layers as between the inner and outer layer jackets without the need for adhesives or bonding agents, which cable exhibits flexibility, and can withstand prolonged exposure to −40° C. temperatures.

2. The cable of claim 1, wherein the two or more insulated conductors include a conductor for a control application and a conductor for a power application.

3. The cable of claim 1, wherein the tensile modulus of the thermoplastic elastomer of the inner layer jacket is approximately 1570 psi, and the tensile modulus of the thermoplastic elastomer of the outer layer jacket is approximately 1230 psi.

4. The cable of claim 1, wherein the tensile modulus of the thermoplastic elastomer of the inner layer jacket is in the range of 1550 to 1650 Pa, and the tensile modulus of the thermoplastic elastomer of the outer layer jacket is in the range of 1180 and 1280 Pa.

5. The cable of claim 1, wherein the tensile strength of the thermoplastic elastomer of the inner layer jacket is approximately 2390 Pa, and the tensile strength of the thermoplastic elastomer of the outer layer jacket is approximately 2180 Pa.

6. The cable of claim 1, wherein the elongation of the thermoplastic elastomer of the inner jacket is in the range of 310 to 370 percent, and the elongation of the thermoplastic elastomer of the outer jacket is in the range of 290 to 340 percent.

7. The cable of claim 1, wherein the elongation of the thermoplastic elastomer of the inner jacket is approximately 340 percent, and the elongation of the thermoplastic elastomer of the outer jacket is approximately 323 percent.

8. The cable of claim 1, wherein the tensile strength rating of the inner layer jacket is approximately 9.8% greater than the tensile strength rating of the outer layer jacket, and the elongation of the inner layer jacket is approximately 5.3% greater than the elongation of the outer layer jacket, and the tensile modulus of the inner layer jacket is approximately 27.6% greater than the tensile modulus of the outer layer jacket.

9. The cable of claim 1, wherein the cable is formed as a tubed jacket.

10. The cable of claim 1, wherein the cable is formed by pressure extruding the inner layer and outer layer about the two or more insulated conductors.

11. The cable of claim 1, wherein the cable has no central gap or space in which the conductors may move to under stress.

12. A lift device comprising:

a base unit;

a platform;

an arm having a first end and a second end, one end mounted to the base unit and the other end is mounted to the platform, the arm having a plurality of flat plates which, in part, form a mechanical cable track with one or more radius; and one or more multi-conductor cables, each of the multi-conductor cables having two or more insulated conductors, the conductors are 20 AWG or larger in size, each cable further including a dual layer jacket, the dual layer jacket having an inner layer jacket having a thermoplastic elastomer having a tensile modulus of at least 1550 psi to resist stretching forces externally applied to the cable, and an outer layer jacket having a thermoplastic elastomer having a tensile modulus no greater than 1300 psi, wherein the inner layer and outer layer are co-extruded, which co-extrusion naturally forms distinct but inseparable layers as between the inner and outer layer jackets without the need for adhesives or bonding agents, which cable exhibits flexibility, and can withstand prolonged exposure to −40° C. temperatures.

13. A method of manufacturing a multi-conductor cable adapted for use in a mechanical cable track, wherein the cable is subjected to contraction in the extension mode of the track, and a wiping or milking action applied to the cables outer contact surface, the method comprising the steps of:

providing two or more insulated conductors, the conductors having a 20 AWG or larger size;

selecting a thermoplastic elastomer as a first material for an inner layer jacket, the first material for the inner layer jacket having a tensile modulus of at least 1550 psi to resist stretching forces externally applied to the cable;

selecting a thermoplastic elastomer as a second material for an outer layer jacket, the second material having a tensile modulus of no greater than 1300 psi to avoid breakdown and cracking as the cable is wiped or rubbed against external surfaces, and that resists track abrading; and co-extruding the first material and the second material to form the inner layer jacket and the outer layer jacket, wherein the similar material chemistry of the first material and the second material results in a natural melt bond between the inner layer jacket and the outer layer jacket.

14. The method of claim 13, wherein the step of selecting the first material includes selecting a material having a tensile modulus of approximately 1570 psi, and the step of selecting the second material includes selecting a material having a tensile modulus of approximately 1230 psi.

15. The method of claim 13, wherein the step of selecting the first material includes selecting a material having a tensile strength of approximately 2390 Pa, and the step of selecting the second material includes selecting a material having a tensile strength of approximately 2180 Pa.

16. The method of claim 13, wherein the step of selecting the first material includes selecting a material having an elongation of approximately 340 percent, and the step of selecting the second material includes selecting a material having an elongation of approximately 323 percent.

* * * * *